US005515580A

United States Patent [19]

McHenry, Jr.

[11] Patent Number: 5,515,580

[45] Date of Patent: May 14, 1996

[54] CURLY CORD AUTOMATIC BINDING TIE

[75] Inventor: David C. McHenry, Jr., Stone Mountain, Ga.

[73] Assignee: Kurly Tie Company, Stone Mountain, Ga.

[21] Appl. No.: 265,651

[22] Filed: Jun. 27, 1994

[51] Int. Cl.[6] ..... A44B 21/00; B65D 63/00

[52] U.S. Cl. ..... 24/16 PB; 24/300; 24/301; 24/715.3

[58] Field of Search ..... 24/16 PB, 16 R, 24/300, 301, 306, 3 M, 712.1, 715.3, 715.4, 129 A, 129 D, 115 H; 248/74.3; 40/316, 645

[56] References Cited

U.S. PATENT DOCUMENTS

| | | | |
|---|---|---|---|
| 1,848,318 | 3/1932 | Ciampi | 24/715.3 |
| 2,994,300 | 8/1961 | Grahling | 24/300 |
| 3,206,814 | 9/1965 | Schumm . | |
| 3,543,353 | 12/1970 | Meenan . | |
| 4,001,919 | 1/1977 | Moberg et al. | 24/16 PB |
| 4,700,432 | 10/1987 | Fennell | 24/16 R |
| 4,893,381 | 1/1990 | Frankel . | |
| 4,910,835 | 3/1990 | Carpenter | 24/169 PB |
| 4,939,818 | 7/1990 | Hahn | 24/16 R |
| 4,991,265 | 2/1991 | Campbell et al. | 24/16 PB |
| 4,994,075 | 2/1991 | Smith et al. | 24/301 |
| 5,167,050 | 12/1992 | Korsen | 24/16 R |
| 5,167,086 | 12/1992 | Fast . | |
| 5,287,601 | 2/1994 | Schweitzer et al. | 24/715.3 |

FOREIGN PATENT DOCUMENTS

| | | | |
|---|---|---|---|
| 0221283 | 7/1968 | Sweden | 40/316 |
| 0868839 | 5/1961 | United Kingdom | 40/316 |
| 0933747 | 8/1963 | United Kingdom | 24/16 R |

*Primary Examiner*—Victor N. Sakran

[57] ABSTRACT

A binding tie device used to either confine and constrict a single object, or else hold two or more objects snugly together. The binding tie includes a length of curled cord (10) which will recoil to its curled shape after being stretched straight, a chain (12), made of bead type chain, and split ring (24). The working end of cord (10) and the first end of chain (12) are connected together. Split ring (24) is connected to the second end of chain (12). Split ring (24) is employed to stretch the cord straight and wind it in either direction around the object being tied. Cord (10) automatically turns allowing it to first uncoil when stretched and then recoil as it is wound around the object thereby securely binding the object. Cord (10) is untied by winding in the opposite direction. The first end of chain (12) may be positioned on cord (10) so that the tie with attached object can be hung up or attached by split ring (24).

7 Claims, 5 Drawing Sheets

Figure 3
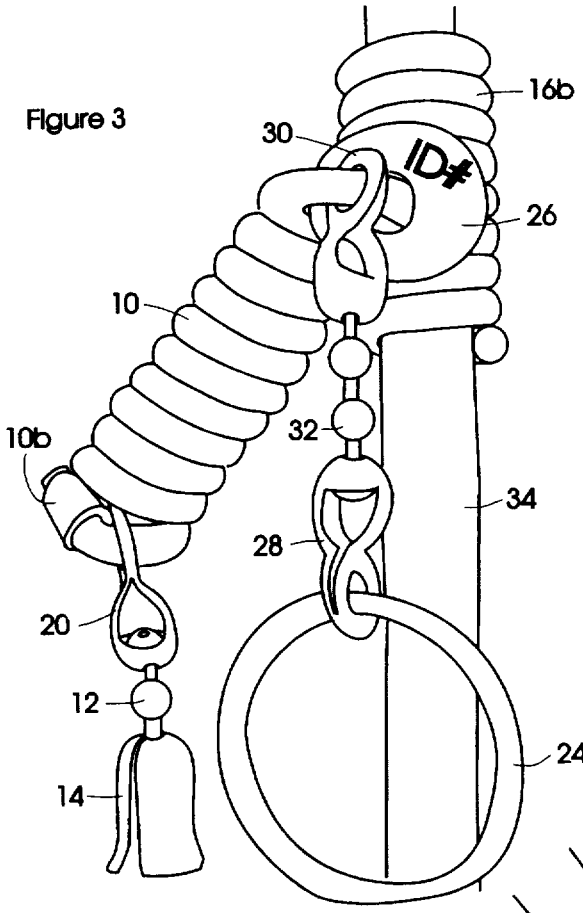
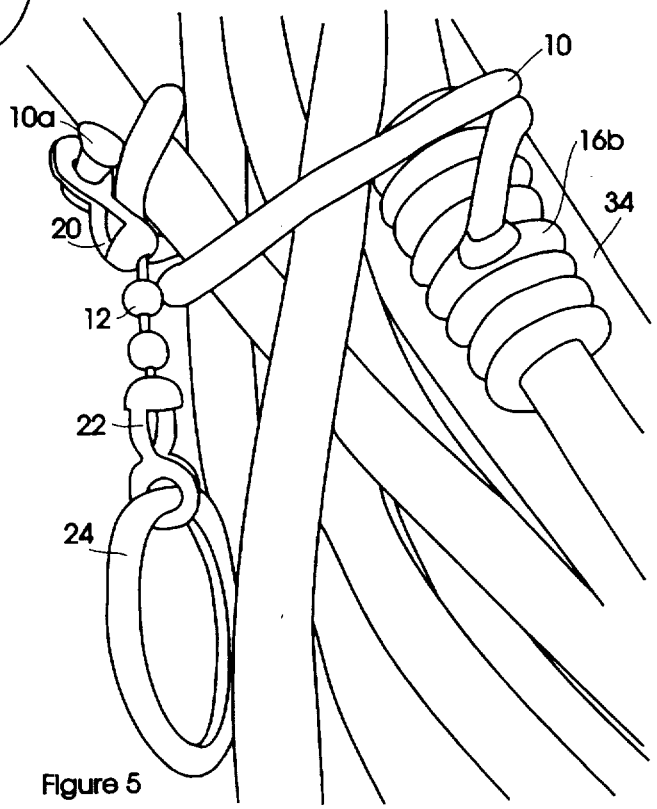
Figure 5

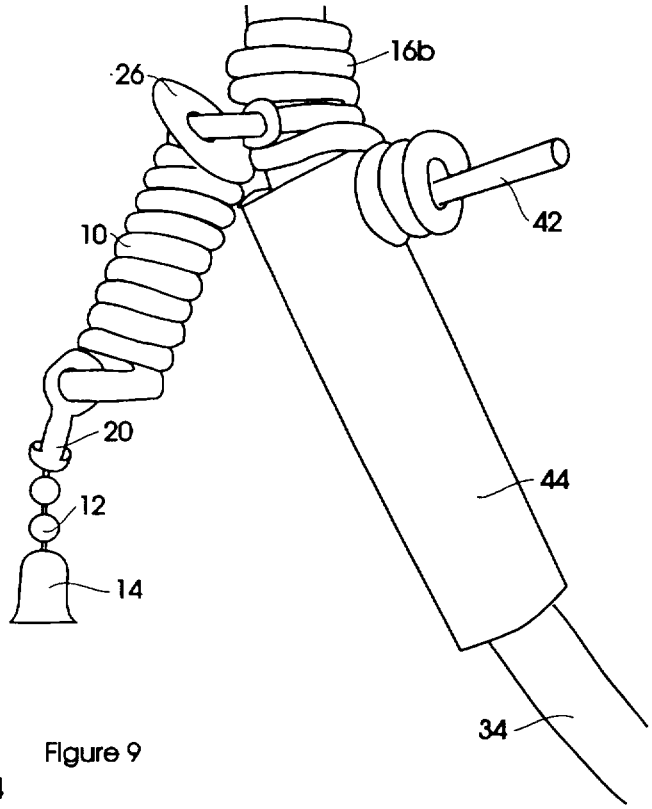
Figure 9
Figure 10
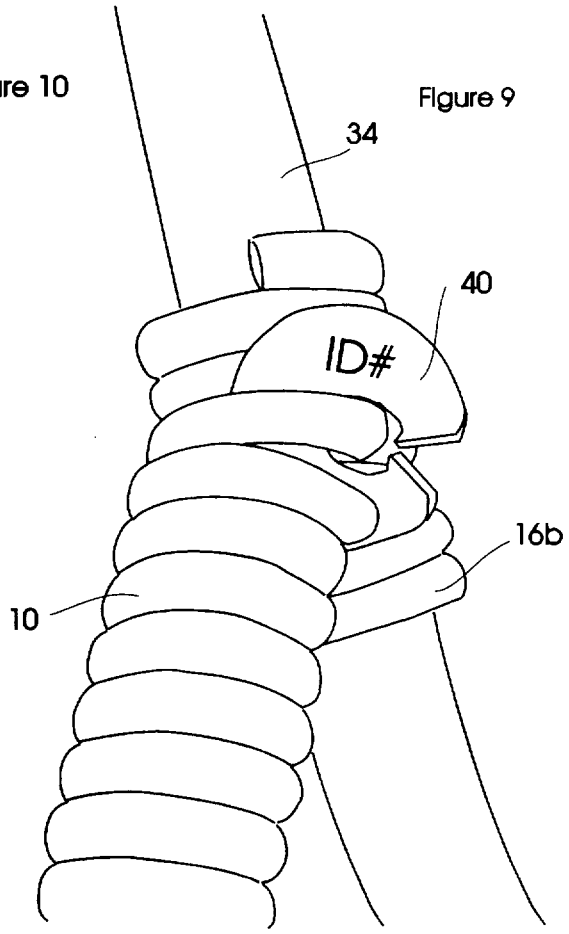

CURLY CORD AUTOMATIC BINDING TIE

BACKGROUND OF THE INVENTION

1. Field of the Invention

This invention relates in general to binding ties and their functional equivalents.

2. Description of the Prior Art

Binding ties are used to either bind and constrict a single object or else hold two or more objects together snugly. All devices and effective construction methods equivalent to this definition shall be called binding ties hereafter, herein.

Binding ties are well known in the present art. The antecedents for modern solutions are found in the most ancient times. Knotting has been an important adjunct to the everyday life of all people from the earliest days of which we have knowledge.

The following quotations from Clifford W. Ashley's Complete Book of Knots are recited here for the sake of reviewing useful prior art and to establish a nomenclature within which to discuss the present invention which is in keeping with earliest tradition in the art.

"The end of a rope is its extremity."

"The standing part is the inactive part, as opposed to the bight and working end."

"The bight of a rope is a term meaning . . . any central part of a rope, as distinct from the end and standing part."

"Binding ties serve two purposes. They either confine and constrict a single object, or else they hold two or more objects snugly together.

Among available knots to serve the purpose Ashley describes nearly 40 knots. Among these the Constrictor Knot is best for the purpose. "So long as the constrictor is tied over a convex surface it will not slip. It draws up easily, has a ratchetlike grip and is the most secure of all binding knots."

Learning the correct knots and keeping appropriate cordage handy would be sufficient to the task for binding most objects. Unfortunately many people never learned another useful knot after learning to tie their shoes.

ALTERNATIVES TO KNOTTED CORD

Binding methods alternate to tied knots abound in the art and can be divided into two categories:

Found objects or basic materials make up the first category. Popular is such stuff as stiff wire, various adhesive tapes, elastic bands. etc.

Articles of manufacture form the second group including wire twist-ties, buckled straps, hook and loop type straps, and a wide variety of devices wherein the tie end must be aligned then threaded through an aperture which employs a ratchet type lock in co-action with the bight of the tie.

STATE OF PRESENT ART AND DESIRABLE FEATURES

Any method or device which would compete with present art binding ties must be quickly tied and untied, convenient, self-adjusting, reusable and reliable. There are many other desirable features which an improved method or design could possess. Present art articles of manufacture, though complex and expensive, lack such features. Some of these desirable features are discussed here.

(a) That a binding tie establish and maintain proper tension on the tied object is important. Some binding ties such as the common nylon cable tie are prone to being too tight thereby damaging the tied object. A common nylon cable tie once over tightened cannot be loosened. Additionally most binding tie devices are not elastic and become loose when the tied object shifts or settles. It is desirable that tension be consistent on the basis of a quick, uncomplicated tying method. Shifting or contracting of the tied object should be taken up by the binding tie.

(b) Binding ties which require threading the free end through an aperture are undesirable. Fastening these ties is tedious and inconvenient, requiring both hands working in unison. A device which eliminates the need for threading the tie is desirable.

(c) Prior art features many binding ties with holding forces that are excessive for certain jobs and offer no adjustability of holding force. It is good to have the binding tie release unharmed if subjected to excessive load. Such release will protect the binding tie and the tied object from damage. It is desirable for a binding tie to have limited holding force which is in keeping with its task. It is also desirable that a binding tie will release undamaged if excessively loaded and for the release force to be adjustable subject to the manner of deployment.

(d) For convenience some binding tie devices include or feature as options ways to position the binding tie where it is to be tied.

Drawstring bags position the binding tie at the neck of the bag with an integral sleeve or series of holes. The bight of the tie is threaded through the sleeve or holes.

The RIP TIE (tm) patented tie, Michael P. Fennell, issued Oct. 20, 1987 (U.S. Pat. No. 4,700,432) is one of the first of many patented hook and loop binding ties. A RIP-TIE is fastened to a section of the elongate object to be tied with a common nylon cable tie. This combination not only holds the tie in place where it will be tied it is requisite to the efficient function of the tie. If the standing end is not fastened to a cord or cable there is no convenient way to hold it as the tie is wrapped around an object being tied. Most other the hook and loop ties share this requirement. They claim to fasten the tie to the elongate object only as a convenience. In reality the section of elongate member fastened to the standing end of the tie becomes an integral and necessary part of the device.

Common nylon ties can be positioned with a special tool which also tightens them and cuts off the loose end.

An improved binding tie would provide a way to hold the tie in position on the object to be tied. Different applications call for different ways of positioning the tie. The tie may be held manually in place for tying. The binding tie may be made part of a larger assembly in which it is used.

For ties used to fasten elongate members there should be a way of fastening the binding tie in tying position on a section of the elongate object. It is desirable that this fastening be semi-permanent, removable. repositionable, and reusable without requiring the use of tools.

(e) In most prior art the end or ends of the tie are left hanging or sticking straight out from the tied object. At best they are an untidy nuisance and on some designs if inadvertently pulled the tie may come loose.

Some models of the releasable and reusable QuicKlips brand ties by Jilson of Lodi, N.J. use the loose working end to double lock the ratcheted head. The end is still left sticking out and the tie will may come loose if it is pulled or snagged.

One time disposable common nylon cable ties are usually cut flush. The sharp ends thus formed can easily cause painful scrapes.

It is desirable that ends of the tie be neatly tucked in and secured.

(f) Most binding tie devices are made of materials which are smooth and slippery such as cloth, molded plastics or die cut plastic. Such surfaces allow tied objects to slip. It is desirable that a binding tie grip and hold smooth surfaces.

(g) Need arises to add to that which is already tied by the tie. The need may be to untie only a portion of that which is tied. The bundling device of U.S. Pat. No. 5,167,050, David W. Korsen. Dec. 1, 1992 provides a limited means for such partial tying. Common nylon cable ties cannot be undone. They are therefore cut off and wasted. Other methods require that the binding tie be all unthreaded or otherwise undone. Gathering the tied object together must then be repeated. It is desirable that a binding tie could come only partially undone. This would allow adding or subtracting material or elements to that which is tied.

(h) Gathering together the material being tied usually precedes tying the tied object. Gathering the object then holding it while threading and tightening the tie can be a challenge. It is desirable that the binding tie aid in gathering and holding the object as it is being tied.

(i) On many binding tie devices the end of the tie is useless. It can act only in combination with the mating part of the tie. It is desirable for the free end to possess tying or grasping capacity in itself.

(j) A loop, eye, clasp or hook is often added to binding tie devices. The tied object can then be hung on or attached to a nail, peg, hook or ring. It is desirable for such attachment hardware be integral to the basic tie, not added on to it.

(k) Binding ties employing straps including velcro straps are often impaired by dirt and wetness. Dirt becomes lodged in these cloth like materials. The dirt then comes off elsewhere. On a binding tie used around delicate instruments this is bad news. It is desirable that a binding tie device not easily be soiled or able to hold contaminants. It should also be easily cleaned and dried.

(l) Some binding ties include features allowing identification markings to be placed on the binding tie. These may be aids to identifying the tied object or advertising markings. These identification marking surfaces often are unwieldy and obtrusive. It is desirable for a binding tie to have an unobtrusive, easily written on, removable, and replaceable identification surface.

(m) Ties using hook and loop material have become popular despite undesirable characteristics. These ties undesirably and unexpectedly stick to objects such as clothing, carpet, furniture, and themselves. Hook and loop material based binding ties are also noisy when being released. The ripping sound they make is unpleasant and unwelcome in audio-visual production environments where they are often used. It is desirable for a binding tie not to stick to other objects or make noise.

(n) Several ties for bundling elongate objects include ways to attach them to a section of elongate object (see item "d"). Attaching these ties, especially the RIP-TIE, is a tedious job and must be done by hand. It is desirable to provide a machine and/or hand operated device to make the job quick and easy.

CURLY MATERIALS AS BINDING TIES

Use of curly shaped materials as binding ties is limited. This is largely because materials good for the purpose were unknown until relatively recent.

Spiral cut tubing is widely used to wrap wiring harnesses. Spiral cut tubing has very limited size range. Any given size cannot expand much so there have to be several different stock sizes. Installing spiral cut tubing is an ordeal.

National Band and Tag Company of Newport, Ky. states that their best selling product is a spiral plastic band which is made of just under two turns of cylindrically coiled solid round plastic cable. Among uses sighted are electrical wire harnessing and animal tagging both of which are binding ties.

Despite this, using plastic coils of the type herein described as binding ties has been sighted as novel in the literature of the associated arts. Such use is often believed to constitute invention by those who see it demonstrated.

A successful binding tie which I currently make and sell is made of coiled plastic cord. The coiled cord is wound around the tied object while avoiding twisting it. For the tie to be secure the coil's original inside diameter must be kept inside against the bound object, the outside diameter kept outside. The coil diameter is stretched through a tremendous range. The material bends but stretches very little. The coiled cord's tendency to kink is checked by its tight contact against the tied object.

In other art employing a coil as a tie U.S. Pat. No. 5,167,086, Jacob Fast uses a flat coil for tying an identification tag on the limb or stem of a plant. Here the coil is not used to bind the object but only to attach an integrally formed identification surface.

So the reader can see that articles of manufacture using a curly or coiled cord as a general purpose binding tie are generally and specifically unknown.

OBJECTS AND ADVANTAGES

Accordingly it is the object of the present invention to provide a method and device which can easily and quickly position and tie a curled cord as a self adjusting, reusable, and reliable binding tie while providing these additional advantages:

(a) provide a binding tie which is self tensioning and which will tighten itself and not go slack if the bound object contracts.

(b) provide a binding tie that's use does not require that the working end be threaded through an aperture.

(c) to provide a binding tie which releases safely when overloaded and will allow adjustment of the holding force thereby protecting valuable tied items, and the tie itself.

(d) to provide a way to hold the binding tie in tying position. The curly cord automatic binding tie is easily made part of larger structures in which it is used. The curly cord automatic binding tie also provides a way to semi-permanently attach itself to a section of elongate member. This attachment is removable, repositionable, and reusable, all without requiring the use of tools.

(e) to provide positive locking of the end to render it neatly and securely tucked away.

(f) to provide a binding tie with a rubbery surface that will grab and hold smooth, slippery surfaces.

(g) to provide a binding tie which though tied will open partially to add to the tied object without having to be destroyed or capsizing. The curly cord automatic binding tie also may be tied so as to divide up the bound object into separately releasable portions.

(h) to provide a binding tie which will aid in gathering and holding together the object being tied.

(i) to provide a binding tie where the working end has inherit prehensile properties.

(j) to provide a binding tie which includes secure means for hanging or attaching the tied object to a ringlike or hooklike fastening point without added elements.

(k) provide a binding tie which is hard to soil and easy to clean and dry.

(l) to provide a binding tie with an easily written on and/or pre-printed identification tag which is unobtrusive, removable and replaceable.

(m) to provide a binding tie which overcomes disadvantages of hook and loop fasteners. The curly cord automatic binding tie will not undesirably and unexpectedly anchor itself to clothing furniture, carpet or the like. The curly cord automatic binding tie is silent in use.

(n) to provide a mechanized way to attach the tie to a section of elongate member. This will save time and effort.

Further objects and advantages of the curly cord automatic binding tie may be drawn from consideration of the ensuing description and accompanying drawings.

BRIEF DESCRIPTION OF THE DRAWINGS

FIG. 3 shows a curly cord automatic binding tie as in FIG. 2 with added elements for identification markings and elements for hanging and attaching.

FIG. 5 shows a version of the curly cord automatic binding tie securely tied around a bundle of elongate members.

FIG. 9 shows a curly cord automatic binding tie being attached to a section of an elongate member with a specialized tool.

FIG. 10 shows a close up partial view of a curly cord automatic binding tie with a removable and replaceable identification tag installed.

SUMMARY OF THE INVENTION

A novel device is disclosed for employing a length of curly cord possessing shape memory as a binding tie. One end of the cord is held adjacent to the object to be tied. One end of a rotationally free and self-aligning coupling is connected to the other end of the cord. The second end of coupling is connected to grasping and attaching hardware. Based on such a structure, a novel technique is disclosed to either confine and constrict a single object, or else hold two or more objects snugly together. Other novel features are added and noted.

DETAILED DESCRIPTION OF PREFERRED EMBODIMENT

Figure 1:
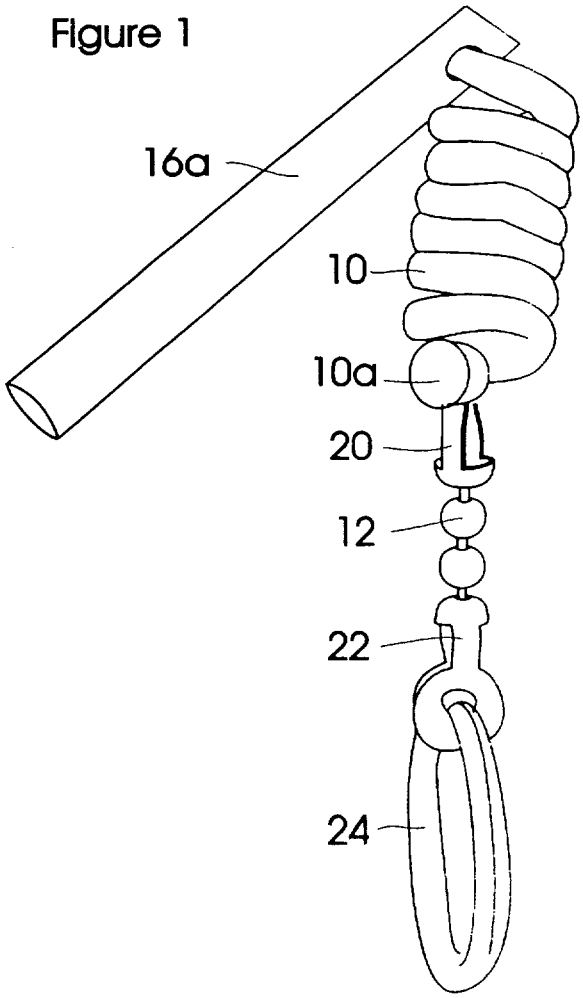
FIG. 1 shows a curly cord automatic binding tie which is self-contained and easily moved from one tying job to the next.

A typical embodiment of the binding tie of the present invention is illustrated in FIG. 1. The binding tie has an elongate object, line, lanyard, length of extruded shape or cord 10 consisting of a length of solid or hollow material formed in a substantially coil shape. Cord 10 is made of a material which will bend easily but stretch in length very little, such as the non-electrical retractile cords made by Freelin-Wade of McMinnville, Oreg. The coil shape can be stretched out straight repeatedly and will curl back up to substantially the same diameter when released. The material Freelin Wade uses is proprietary but it is a thermoplastic believed to be either a thermoplastic rubber or a polyurethane compound. However cord 10 can consist of any other material that has enough shape memory. Other acceptable materials include rubber encased wire, various plasticized materials, various woven constructions and a variety of plastic polymers. In a single use version of the present invention cord 10 need curl back up as described only once.

The standing part end of cord 10 passes through a hole 18 in a positioning handle **16*a* and is prevented from coming out by an integral end stop (not shown). Positioning handle 16*a*** may be made of any material strong enough and may be made in a wide variety of shapes and sizes.

The working end of the cord 10 goes though the eye of a sliding end ring or eyelet connector 20. Eyelet connector 20 is a type "A" connector for standard bead type chain. Eyelet connector 20 is free to slide along the length of cord 10 but is prevented from sliding off by integral end stop **10*a***.

Eyelet connector 20 is attached to one end of a chain 12 which is made of common bead type chain. The other end of chain 12 is attached to a coupling connector 22. A clasp or split ring 24 of the type used for keys is threaded through the eye of coupling connector 22.

Figure 2:
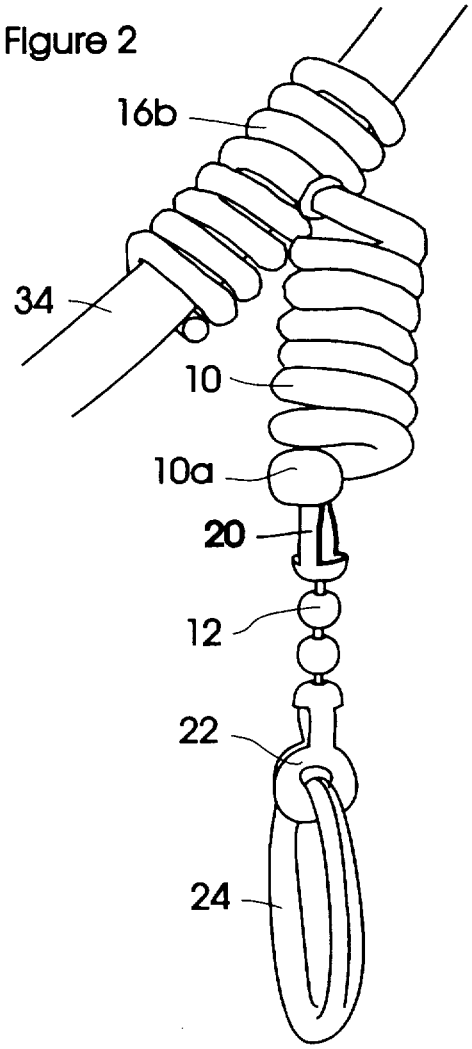
FIG. 2 shows a curly cord automatic binding tie inventively adapted for semi-permanent attachment to an elongate object.

FIG. 2 shows a perspective view of a basic embodiment of the curly cord automatic binding tie. Here the invention is adapted in a novel way for semi-permanent attachment to elongate objects. This embodiment is similar to FIG. 1 except positioning handle **16*a* is replaced by a positioning coil 16*b*. The approximate mid point of positioning coil 16*b* is joined, on its outside diameter, to the standing part end of cord 10. Positioning coil 16*b* is made of the same material as cord 10 and is joined to it by a thermal weld. This positioning coil 16*b* might alternatively be mechanically attached or be formed integral to cord 10. Positioning coil 16*b* is shown wound around a section of an elongate object 34. This combination provides a structure functionally equivalent to positioning stick 16*a*. Attachment to elongate object 34** is secure yet semi-permanent. In this embodiment the curly cord automatic binding tie can be released, repositioned, or removed and used elsewhere all without requiring the use of tools.

FIG. 3 shows a perspective view of a preferred embodiment of the present invention. This embodiment adds dedicated hanging or attaching hardware and identification surfaces. Cord 10 is fastened to positioning coil **16*b*** as in FIG.

2. Eyelet connector 20 slides over cord 10 as described above and is held from sliding off by crimped end stop 10*b*. Eyelet connector 20 is attached to one end of chain 12. Attached to the other end of chain 12 is a pendant 14. An identification washer 26 is mounted around the standing part end of the cord 10. Identification washer 26 bears identification markings which may be preprinted or handwritten. Identification washer 26 may alternatively be made like pliable closures for flexible bags so it can be removed and replaced. This type of washer is shown in separate detail in FIG. 10. Dedicated hanging or attaching hardware is connected as follows: The standing part end of cord 10 is threaded through the eye of a hang eyelet connector 30 identical to eyelet connector 20. A hang chain 32, hang coupling connector 28 and split ring 24 are connected in sequence to hang eyelet connector 30 as shown.

FIG. 5 is a close up perspective view of the curly cord automatic binding tie similar to FIG. 2. Cord 10 is shown tied around gathered up elongate object 34. The working end of cord 10 is "loop locked" securely around the elongate object.

Figure 6:
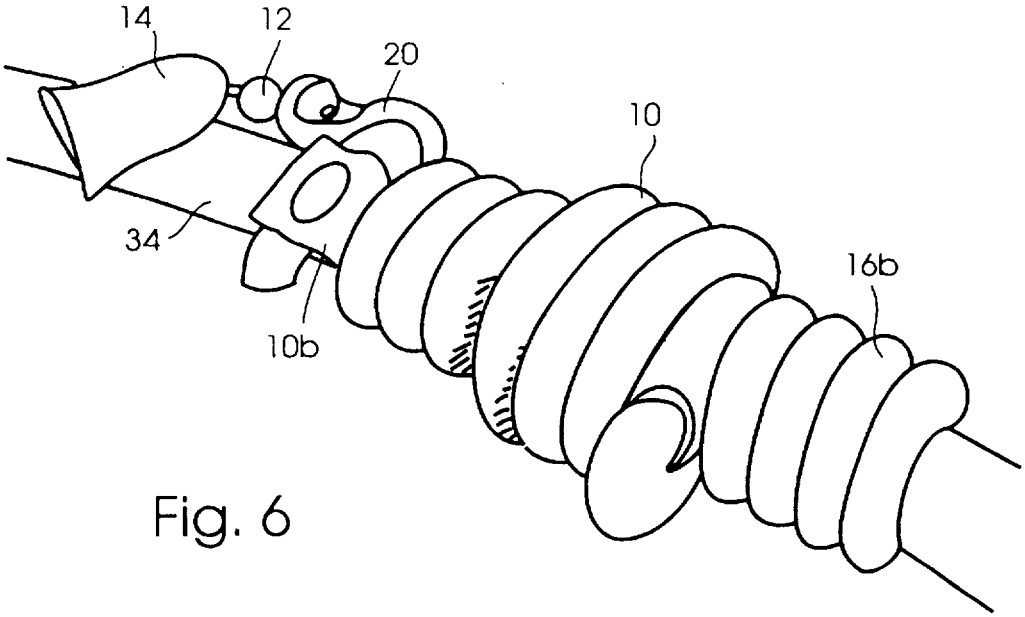
FIG. 6 shows a curly cord automatic binding tied back around itself and a section of elongate member. This makes the tie less obtrusive when not in use.

FIG. 6 shows a perspective view of the curly cord automatic binding tie where cord 10 is tied so as to be less obtrusive. The embodiment is similar to FIG. 2 but with pendant 14 replacing split ring 24 and coupling connector 22. Cord 10 is wound around both the positioning coil 16*b* and elongate object 34. In this way the binding tie is made unobtrusive to the form and function of the elongate member. The tie is always there when needed but will never get in the way.

Figure 7:
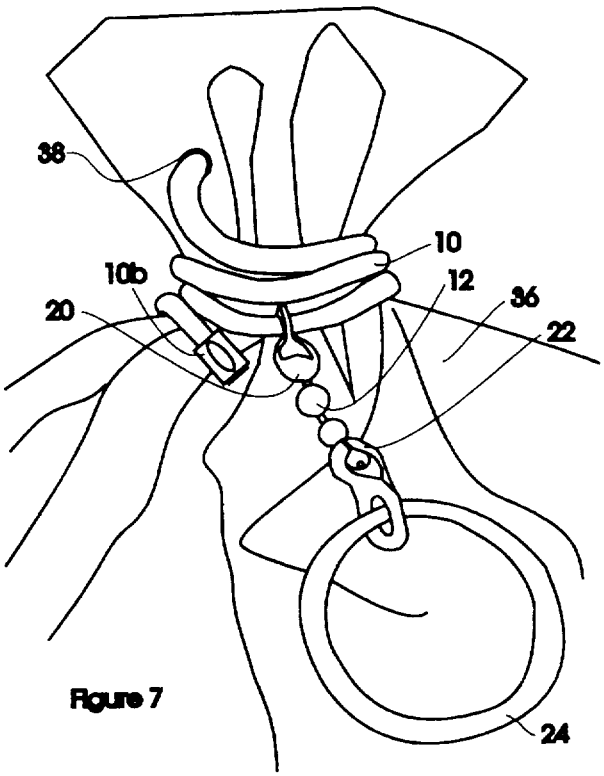
FIG. 7 shows a curly cord automatic binding tie made integral to a larger structure, in this case a cloth bag.

FIG. 7 shows a perspective view of an embodiment where a curly cord automatic binding tie is made integral to a larger structure, in this case a bag 36. Cord 10 is shown tied so that the neck of the bag is held closed. Eyelet connector 20 is shown where it has been repositioned away from the working end of cord 10. With eyelet connector 20 positioned this way bag 36 may be hung or attached by split ring 24. Cord 10 will remain securely tied. The standing end of cord 10 is threaded through an opening 38. An end stop in cord 10 which is not visible in this view prevents the standing end of cord 10 from coming out through opening 38. The working end of cord 10 with crimped end stop 10*b* tucks securely into folds of bag 36.

Figure 8:
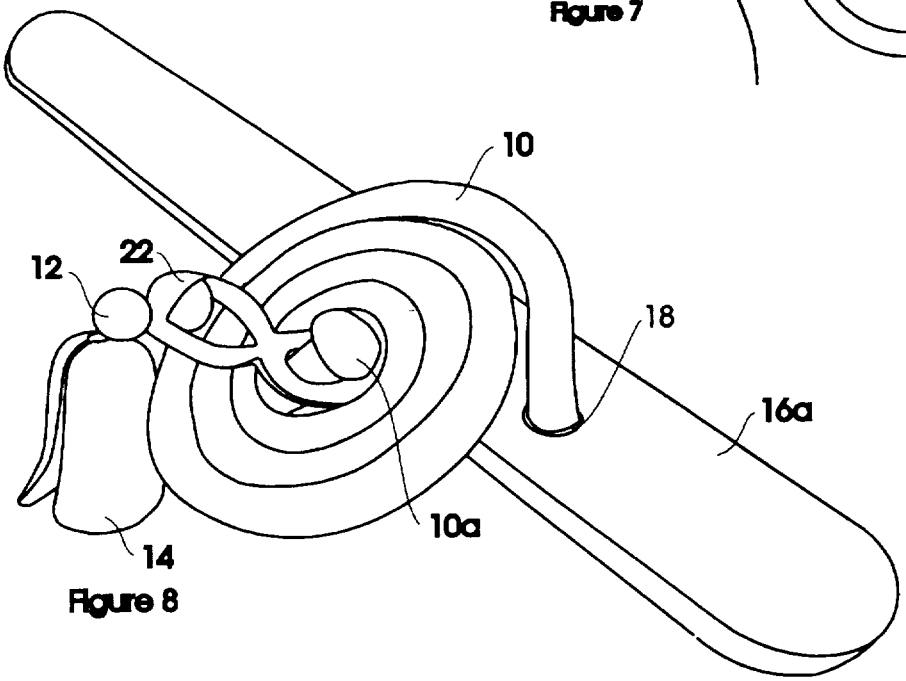
FIG. 8 shows a curly cord automatic binding tie where the curly cord's initial substantially coil shape is flat rather than cylindrical.

FIG. 8 shows a perspective view of a basic embodiment of the curly cord automatic binding tie very similar to FIG. 1. In this version the initial coiled shape of cord 10 is a flat rather than cylindrical coil. This flat coil works comparably to the cylindrical coil as a binding tie. All parts in this figure interconnect as described for other figures.

FIG. 9 shows a specialized tool for installing the present invention where the positioning means is positioning coil 16*b* in combination with a section of elongate object 34. This tool is made up of a payout pin 42 mounted perpendicular near the end of a split tube 44. The split tube is open on the side opposite pin 42 from end to end. This is opening is not visible in the view of FIG. 9.

A coil spring with its multiple coil windings makes an effective binding device once it is in place around an object. The problem is in getting it wrapped around the object. I am currently making and selling a coiled plastic cord as a binding tie. It is commercially successful but is awkward to tie around an object. The curly cord automatic binding tie makes the task easy and quick.

Figure 4:
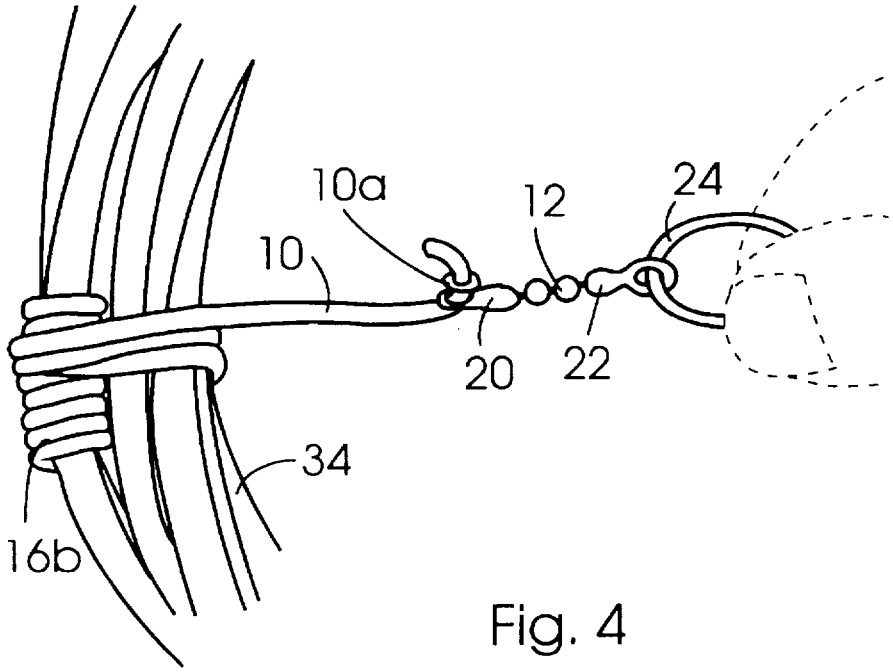
FIG. 4 shows the method for used for tying a curly cord automatic binding tie around an object.

FIG. 4 shows a perspective view of the present invention in the version of FIG. 2. The view shows cord 10 being tied around elongate object 34. This is the standard method for tying any embodiment of the present invention. It is done in three steps.

The first step in the tying operation is to bring the standing part end of cord 10 adjacent to the object to be tied. This is done with positioning handle 16*a* or its functional equivalents. These equivalents include positioning coil 16*b* in combination with a section of elongate object 34, as in FIG. 4 or attachment of standing part end of cord 10 to a larger structure such as bag 36 in FIG. 7.

The second step is to pull out on the split ring 24 thereby stretching out cord 10 until it is stretched straight and perpendicular to the axis of the object to be tied. As cord 10 is stretched straight its coil shape is caused to unwind. The rotational freedom of chain 12 allows cord 10 to turn in free response to this unwinding force. Cord 10 should not be touched as this will prevent it from unwinding in free response.

The third step in tying the binding tie is to wind cord 10 around elongate object 34 in either direction while keeping it stretched straight and perpendicular to the axis of elongate object 34. Cord 10 will turn in the opposite direction from the second step. Cord 10 will recoil itself automatically around the object to be tied. The cord's original inside remains inside, putting the squeeze on the bundled elongate object 34. The tied object is thus encircled, gathered and constricted as cord 10 is wound around it. Once cord 10 is fully wound around the object to be tied the tie is complete.

The object can be untied in an instant by pulling split ring 24. During the unwinding process cord 10 need not be kept straightened. If reasonable care is taken when unwinding cord 10 it will recoil in a single neat coil shape. If cord 10 is unwound carelessly and haphazardly it may twist up like a phone cord gone wrong. This poses no problem to the functioning of the present invention. A much used curly cord binding tie may loose its substantially whole coiled shape coming to resemble a mass of curled cord. It will still function properly when used as described.

The working end of cord 10 will remain wound against the tied object due to the constricting force it exerts toward the center. In some cases the loop at the working end may curl up and flop over sideways against the tied object. If cord 10 is long enough the bight of the cord will remain wound tightly until it is untied. Cord 10 may be long enough for only a turn or two around the tied object. In this case or for added security it may be desirable to "loop lock" the working end.

To "loop lock" the working end of cord 10 the curled end is simply hooked around a convenient anchor. In any embodiment of the curly cord automatic binding tie the standing part end of cord 10 is always available as such an anchor. On bundled elongate members the curled end can be hooked around a section of the elongate member itself. This is shown in FIG. 5. Loop locking the working end is a good idea when hanging or attaching the tied object.

It is often convenient to have a way to hang or attach a tied object unto another object such as a hook, nail or D-ring. The most basic version of the curly cord automatic binding tie may be used to securely hang the tied object. In FIG. 7 bag 36 is ready to be hung. To do this the neck of bag 36 is first tied with cord 10. Eyelet connector 20 is then slid along cord 10 away from the working end. Eyelet connector 20 should be moved at least one turn around the tied neck of bag 36 away from crimped end stop 10*a*. Bag 10 can then be hung by split ring 24.

Moving eyelet connector 20 is sometimes not necessary. An example is when a multiple turns of an elongate object have been gathered together and then tied with the curly cord automatic binding tie. After winding cord 10 around the gathered bundle the cord is prevented from coming undone simply by passing split ring 24 through the loop formed by the elongate object. The object may then be safely hung up or attached.

The curly cord automatic binding tie as shown in FIG. 3 makes hanging the tied object even easier. Here separate dedicated hardware is used for hanging or attaching the tied object. Hang coupling connector 28, hang eyelet connector 30, hang chain 32 and split ring 24 make up the dedicated hardware in this embodiment. The tied object can be hung without moving eyelet connector 20.

To reduce the holding force of cord 10 can be wound around the object fewer times or not loop locked. This can provide safe tying of delicate items like scope probes. Conversely double loop locking the end makes a very strong tie point.

The curly cord is prehensile in itself. It can grab objects. Wound on the end of a smooth shaft it holds tight. Hooked over a console door lip it will hold. In embodiments where the standing end of the cord is connected to the object to be tied the prehensile working end allows the cord to suspend or fasten the connected object.

The curly cord binding tie is very versatile can be used in many other ways.

The tool shown in FIG. 9 for installing positioning coil **16*b* on a section of elongate member is easy to operate. To use this tool split tube 44 is first placed over elongate object 34. Positioning coil 16*b* is then slipped over pin 42. The end of positioning coil 16*b* is held together with elongate object 34. Rotating the tool on elongate object 34 causes positioning coil 16*b* to wind off pin 42 and onto elongate object 34**. This method may be adapted for operation within a machine designed for the purpose. The split tube is open on one side from end to end. This is so it can be placed on an elongate object when it can not be threaded over the elongate object.

Theory of Operation:

I don't know the scientific reason why cord 10 does what it does in the operation of the curly cord automatic binding tie. Whatever the reason it behaves as it does it is extraordinarily well adapted to the purpose.

The interaction between cord 10, and chain 12 is fundamental to the automatic operation of the curly cord binding tie. As cord 10 is stretched straight the twist in it, resulting from its coiled shape, makes it try to turn. Chain 12 allows the twist in cord 10 to unwind nearly fully and with case. Chain 12 also allows cord 10 to turn freely in the opposite direction as it recoils while being wound around the object being tied.

Chain 12 is allows cord 10 to turn freely not only because each bead in the chain has two rotationally free bearings. The bead chain's flexibility forces these rotational bearing axes to self-align with the straight stretched cord 10. The relative orientation between the operator's hand which grasps the end of the chain and the object being tied varies and cannot be controlled. Therefore, without the self-aligning capacity of chain 10 its rotational bearings would bind. The unwinding force cord 10 exerts as it is stretched straight is small. Unless the bearing axes remains straight in line with cord 10 the coil shape may not unwind or rewind. Cord 10 must unwind as it is stretched and rewind as it is wound around the object being tied. If not it will fail to recoil itself with its inside diameter surface toward the object being tied. The resulting binding tie will fail to hold the tied object.

Conclusion, Ramifications and Scope of Invention

Thus the reader will see that the binding tie of the invention provides a highly reliable and versatile yet economical device which works in an unprecedented manner.

While my above description contains many specificities, these should not be construed as limitations on the scope of the invention, but rather as exemplifications of possible preferred embodiments thereof. Some possible variations have been suggested within the specification, many other variations are possible.

In the example of a disposable or single use version the invention may be comprised of a single flat injection molded part. This version employs a curly cord with a flat coil shape as in FIG. 8. The flat coil is more easily injection molded. An integrally molded coupling is made thin enough in cross section that it is rotationally free and self aligning. The coupling is rotationally free since its small cross section allows it to absorb twist relatively easily. A grasping tab is molded in at the extreme end of the coupling. The standing end of this one piece injection molded curly cord automatic binding tie can be fastened to a larger structure in a variety of conventional ways.

Any coupling between split ring 24 or pendant 14 and cord's 10 working end which is rotationally free and self-aligning will suit the functional requirements. Split ring 24 or pendant 14 are not necessary to the function of the curly cord automatic binding tie since chain 12 can be grasped by its end and held in this way as cord 10 is wound around an object.

In embodiments where positioning coil **16*b*** is used it may alternatively consist of a rigid material. The rigid injection molded positioning coil is an open helical coil with tapered ends. Sufficient opening between turns allows the section of elongate member to be wound into the center of the positioning coil. A hole at the coil's midpoint holds the standing part end of the curly cord. This end is kept in the hole by a stop.

The curly cord automatic binding tie changes the rules for binding ties. Tying a binding tie has previously required careful, focused attention and precise manipulation of minute elements. Tying the curly cord automatic tie is as casually done as closing a door. For this reason it is a boon to those with arthritis or the physically challenged.

The invention finds its antecedents in the earliest binding knots. The invention is as versatile and even more versatile than these knots. The invention is adapted to a wide field of applications and statutory classes where it is unknown and unanticipated. Accordingly, the scope of the invention should be determined not by the embodiments illustrated, but by the appended claims and their legal equivalents.

I claim:

1. A tie for binding at least one object, comprising:

a. a cord of flexible, curled, elongate material, said cord having a first end and a second end, the cord being wrappable at least once around the object without joining the first and second ends together, the cord defining multiple coil windings;

b. a coupling including means for providing self-aligning, axial rotational freedom, said coupling having a first end and a second end;

c. means for connecting said first end of said cord to said first end of said coupling;

d. positioning means for holding said second end of said cord in place adjacent to the object; and e. grasping means connected to said second end of said coupling whereby said cord can be stretched out and wrapped around said object, each coil winding encircling at least a portion of the object contacting the object along the entire length of the coil winding.

2. The binding tie of claim 1 wherein said cord is composed of polyurethane.

3. The binding tie of claim 1 wherein said positioning means comprises a handle to which said standing end of said cord is attached.

4. The binding tie of claim 1 wherein said positioning means comprises:

a. a positioning coil comprising a substantially helically shaped body of material acting in combination with a section of elongate member which is part of said object where said positioning coil is wound around said section of elongate member.

b. means for connecting said standing end of said cord to said positioning coil approximately halfway along the length of said positioning coil.

5. The binding tie of claim 1 wherein said means for connecting said first end of said cord and said first end of said coupling comprises an eyelet connector through which said cord is threaded and to which said coupling is attached, and an end stop on said cord near said first end of said cord.

6. The binding tie of claim 1 wherein said positioning means comprises said standing end of said cord in combination with a portion of said object to be tied where said standing end of said cord is fastened to said portion of said object.

7. The binding tie of claim 1 wherein said grasping means is provided with an opening for receiving a suspension member for hanging the binding tie with object attached, from said suspension member.

* * * * *